United States Patent [19]

Cabernoch et al.

[11] Patent Number: 4,706,827

[45] Date of Patent: Nov. 17, 1987

[54] CONTAINER SUCH AS A NURSING CONTAINER, AND PACKAGING ARRANGEMENT THEREFOR

[75] Inventors: James L. Cabernoch, Cary; Leonard A. White, Gurnee, both of Ill.

[73] Assignee: Baxter Travenol Laboratories, Inc., Deerfield, Ill.

[21] Appl. No.: 815,299

[22] Filed: Dec. 27, 1985

Related U.S. Application Data

[63] Continuation of Ser. No. 599,295, Apr. 12, 1984, abandoned.

[51] Int. Cl.[4] ..... A61J 9/00; A61J 9/08

[52] U.S. Cl. ..... 215/11.3; 215/11.1; 215/11.6; 222/107; 222/490; 426/117

[58] Field of Search ..... 215/11 R, 11 C, 11 E; 222/107, 490; 426/117, 801, 115

[56] References Cited

U.S. PATENT DOCUMENTS

| | | | |
|---|---|---|---|
| 2,446,451 | 8/1948 | Allen | 215/11 |
| 2,519,986 | 8/1950 | Trout | 215/11 R |
| 2,524,021 | 9/1950 | Rigby et al. | 215/11 |
| 2,541,934 | 2/1951 | Piazze | 215/11 |
| 2,604,222 | 7/1952 | Teague et al. | 215/11 |
| 2,628,906 | 2/1953 | Horan | 215/11 E X |
| 2,628,909 | 2/1953 | Horan | 99/171 |
| 2,628,910 | 2/1953 | Horan | 215/11 E X |
| 2,881,935 | 4/1959 | Garred | 215/11 E |
| 2,885,104 | 5/1959 | Greenspan | 215/11 R X |
| 2,956,702 | 10/1960 | Ransom | 215/11 |
| 2,987,208 | 6/1961 | Ransom | 215/11 |
| 3,075,666 | 1/1963 | Hoffstein | 215/11 |
| 3,117,874 | 1/1964 | Horan | 99/171 |
| 3,204,855 | 9/1965 | Boynton et al. | 229/53 |
| 3,235,128 | 2/1966 | Hansen | 222/107 |
| 3,334,764 | 8/1967 | Fouser | 215/11 R |
| 3,386,604 | 6/1968 | Fields | 215/11 |
| 3,519,157 | 7/1970 | Meierhoefer | 215/11 C |
| 3,523,026 | 8/1970 | Emerson et al. | 215/11 E X |
| 3,537,225 | 11/1970 | Fields | 53/14 |
| 3,586,196 | 6/1971 | Barton et al. | 215/11 |
| 3,593,870 | 7/1971 | Anderson | 215/11 C X |
| 3,627,161 | 12/1971 | Wergeland | 215/11 C |
| 3,651,973 | 3/1972 | Yamauchi | 215/11 E X |
| 3,746,198 | 7/1973 | Howland | 215/11 |
| 3,747,791 | 7/1973 | Fouser | 215/11 R |
| 3,782,578 | 1/1974 | Ballin | 215/46 |
| 3,790,017 | 2/1974 | Fitzpatrick et al. | 215/11 |
| 3,796,337 | 3/1974 | Seunevel | 215/11 |
| 3,804,952 | 4/1974 | MacDonald | 426/117 |
| 3,822,806 | 7/1974 | Grimes | 215/11 E |
| 3,871,542 | 3/1975 | Hammer | 215/11 |
| 4,193,506 | 3/1980 | Trindle et al. | 215/11 |
| 4,238,040 | 12/1980 | Fitzpatrick | 215/11 |

FOREIGN PATENT DOCUMENTS

| | | | |
|---|---|---|---|
| 678359 | 1/1964 | Canada | 128/45 |
| 61868 | 10/1982 | European Pat. Off. | 215/11 C |

*Primary Examiner*—William Price
*Assistant Examiner*—Sue A. Weaver
*Attorney, Agent, or Firm*—Paul C. Flattery; Robert M. Barrett; Kay H. Pierce

[57] ABSTRACT

A container such as a nursing container, and packaging arrangement are disclosed of the type employing a rigid outer sleeve or holder and a flexible inner container. The inner container is pre-filled and sterilized and attached to an access assembly such as a nipple assembly for dispensing the contents. The access assembly, in one embodiment, is attached to and closes one end of the sleeve. In another embodiment, the access assembly is enclosed by the outer sleeve, one end of which is frangibly removable to access the access assembly. A flexible sheet may also be provided to simultaneously seal the ends of a plurality of containers and join them together in an integral packaging arrangement.

18 Claims, 6 Drawing Figures

CONTAINER SUCH AS A NURSING CONTAINER, AND PACKAGING ARRANGEMENT THEREFOR

This application is a continuation of application Ser. No. 599,295, filed 4/12/84, now abandoned.

The present invention relates, in general, to disposable nursing containers used for feeding suckling infants. More particularly, the present invention relates to collapsible nursing containers which permit the dispensing of liquid to an infant without requiring displacement air, and to packaging arrangements for such nursing containers.

Nursing containers have been known in a wide variety of shapes and configurations. The typical, and probably the most familiar nursing container is a rigid glass or plastic bottle closed at one end by a nipple and ring assembly. Although this type of nurser or baby bottle is perhaps best known in connection with home use, where it is usually prepared on an as-needed basis, such nursers have also been prepackaged for use by hospitals and other instutitutions, where it is intended that the nurser will be disposed of after use. Such disposable containers may, of course also be used at home.

Examples of the aforedescribed nursers are shown in U.S. Pat. Nos. 3,838,784 and 3,586,196 to Barton and Herron, which depict a pre-sterilized, one-time use infant nursing container in the form of a glass bottle, sealed by a thin scored metallic seal. A cap or ring which is rotatably secured to the container neck has a projecting means depending from the underside thereof to breach the scored metallic seal when the ring is threaded downwardly. The ring also mounts a nipple for feeding the container contents to an infant. When an infant is to be fed, the user need only remove the nipple cover and rotate the ring downwardly to access the contents.

Although convenient, there are drawbacks to this type of infant nursing container. Because the container is rigid, displacement air must be admitted to permit the dispensing of the contents to the infant. The nipple construction associated with allowing displacement air to enter, however, will sometimes malfunction, resulting in undesirable leakage of liquid from around the periphery of the nipple or preventing discharge of the contents. Moreover, the existence of large quantities of air in the nursing container raises the risk of infant ingestion of air, which is highly undesirable. Finally, glass containers such as those disclosed in the above identified patents, have substantial empty weight, and are subject to breakage, which contribute to a higher shipping cost and increased price to the ultimate consumer.

Another type of nurser, which overcomes many of the problems described above, but which is particularly suited for in-home use where it may be prepared on an as needed basis, is depicted by U.S. Pat. No. 3,790,017 to Fitzpatrick et.al. That nursing container employes a reusable holder and nipple, and one-time flexible liner, which is fitted into the holder at the time of preparing the nursing container. The liner is stretch fit over an open end of the holder and held in place by the resilient nipple, which overfits the end of the holder and the liner.

This latter type of nurser has the advantage of a collapsible inner liner, which permits the dispensing of liquid without requiring displacement air. However, they require a substantial amount of on-site preparation, which is not well suited for institutional applications. In busy hospitals, clinics and the like, it is preferred that the nurser be ready for use immediately upon opening, without requiring the time and effort of trained personnel for preparation and/or sterilization.

Accordingly, it is the general object of the present invention to provide an infant nursing container which does not suffer the drawbacks of the above described nursing containers.

It is a more specific object of the present invention to provide a pre-filled and pre-sterilized nursing container which employs a flexible container wall for permitting dispensing of the contents without displacement air, and which does not require substantial manual preparation or assembly.

It is a further embodiment of the present invention to provide a unique and compact packaging arrangement for shipping, storing and handling such nursing containers.

Briefly, these and other objects and advantages of the present invention are achieved in a nursing container of the type comprising a substantially rigid elongated plastic outer sleeve, which is closed at one end, and a flexible container or pouch secured within the sleeve. In accordance with the present invention, the flexible container is preferably hermetically sealed to isolate the contents from the ambient atmosphere, and thus to maintain the contents in aseptic or sterile condition until used, and a nipple assembly for accessing the container contents is located within the closed end of the container and fixedly attached to the flexible container and to the sleeve. The container may have a separate cover with encloses the nipple assembly, or the side wall of the outer sleeve may enclose the nipple assembly. To access the container contents, the cover or end portion of the sleeve is removed, exposing the nipple assembly.

The nipple assembly is of a self-opening type, such as those disclosed in U.S. patent application Ser. No. 599,305 entitled "Self-Opening Nipple Construction and Nursing Container", now abandoned, in the name of Leonard A. White, which is being filed concurrently with this application. Manual manipulation of the nipple assembly forces an internal accessing member to penetrate the flexible container wall and to permit dispensing of the contents through the nipple assembly.

In accordance with a further aspect of the present invention, a particularly convenient arrangement is provided for handling, storing and shipping a plurality of nursing containers in a unitary package. In accordance with that aspect, a plurality of nursing containers having elongated rigid plastic outer sleeves which enclose the nipple assembly are located in a generally upstanding side by side relation. The end of each container which encloses the nipple assembly is sealed by a continuous layer of flexible material also serves simultaneously to join the containers into a unitary package.

The container of the invention is not limited to a nursing container for formula, but rather may contain other fluids and include an access assembly other than a nipple assembly.

These and other objects of the present invention are set forth in the following detailed description of the attached drawings, which depict the preferred and alternative embodiments of the present invention for the purposes of illustration and not for limitation, and of which:

Figure 1:
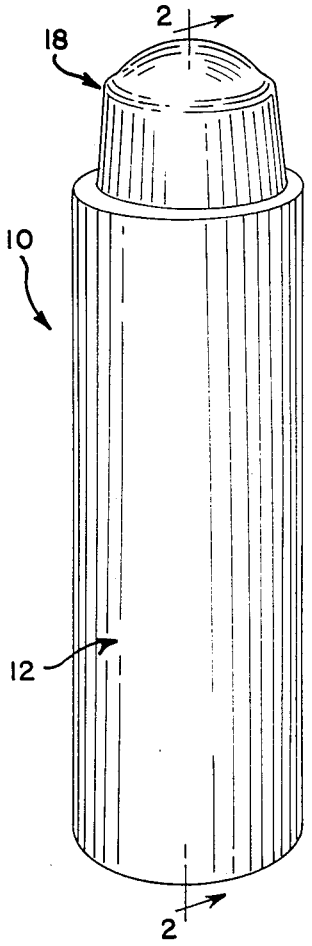
FIG. 1 is a perspective view of a nursing container embodying the present invention.

The present invention is embodied in a nursing container, generally at 10, having a substantially rigid elongated outer plastic sleeve or shell 12 and an internal flexible liquid container or pouch 14. A self-opening nipple assembly 16 is sealed to the wall of the flexible pouch 14 and attached to the rigid shell. In the embodiment depicted in FIG. 2, the nursing container includes a protective cover 18 removably secured over the nipple assembly. In an alternative embodiment depicted in FIG. 5, the side wall of the shell 12 extends upwardly to enclose the nipple assembly and is sealed at the top by a flexible web 20 which also serves to join a plurality of similar nursing containers into a convenient unitary package shown in FIG. 4.

Figure 5:
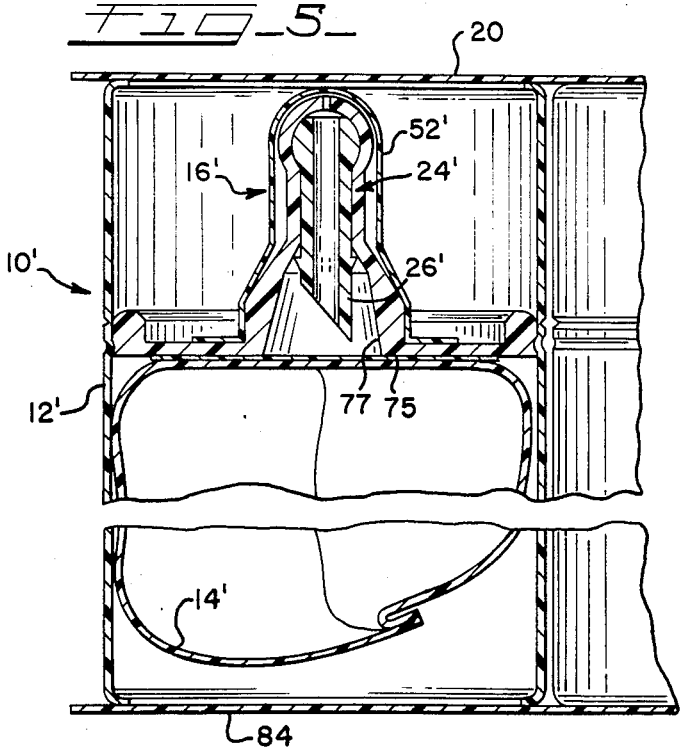
FIG. 5 is a vertical cross-sectional view of an alternative nursing container embodying the present invention and a portion of the packaging arrangement taken along line 5—5 of FIG. 4.

To access the nipple assembly, the sleeve 12 of the container of FIG. 5 has a generally annular line of weakness 22 which is frangible to permit removal of the end of the sleeve enclosing the nipple assembly. The nipple assembly 16 includes a flexible nipple 24, internal accessing member 26 which is movable upon compression of the nipple to pierce the wall of the pouch 14 and permit dispensing of its contents through the nipple.

Figure 2:
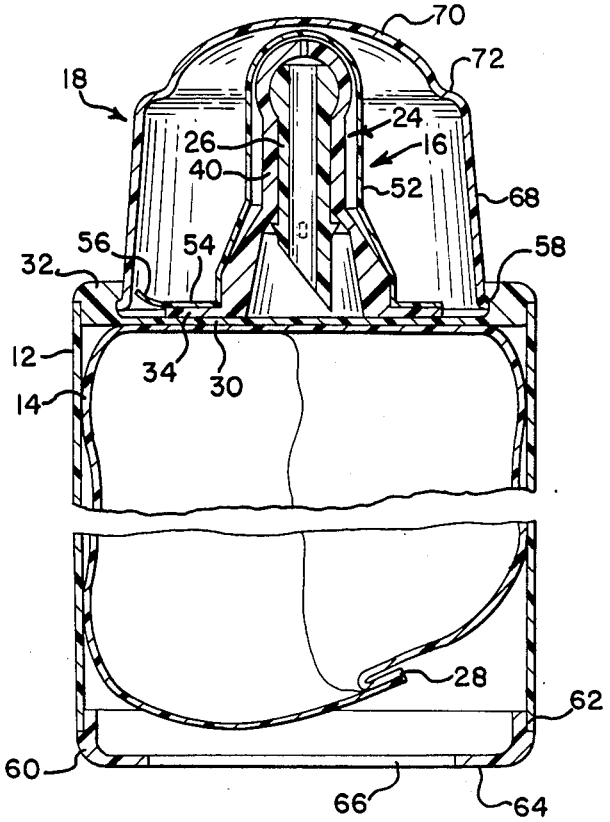
FIG. 2 is a vertical cross-sectional view of the container of FIG. 1.
Figure 3:
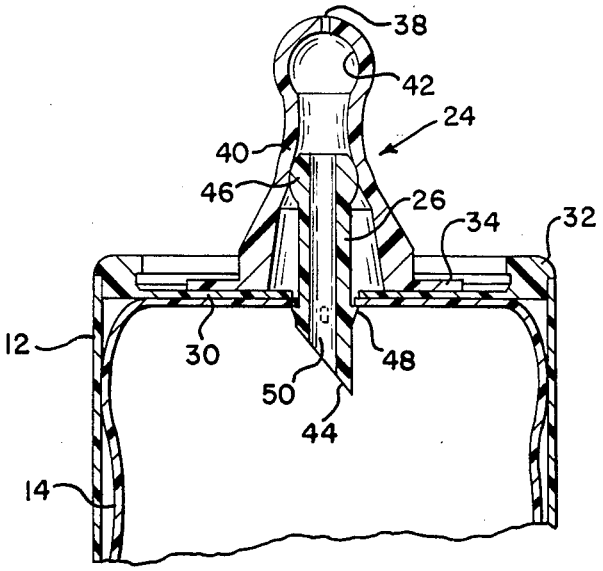
FIG. 3 is a partial vertical cross-sectional view of the container of FIG. 1, with the cover removed and the self-opening nipple assembly in a position piercing the container wall to access the contents of the container.

Turning now to a more detailed description of the attached drawings, the nursing container depicted in FIGS. 1–3 has an outer sleeve 12 which is generally of an elongated cylindrical shape to protect the contents of the flexible container or pouch therewithin, and to provide a container which may sit upright for handling, packaging and storing. The outer sleeve 12 is preferably made of a relatively low-cost plastic material, such as polypropylene, which may be inexpensively formed into the cylindrical shape by a high speed plastic extrusion process. Other materials may, of course, be used. However, it is desirable that any such materials be suitable to withstand boiling water, which may occur if the container is heated, for example, in a pan of boiling water, prior to feeding of an infant. The length of the sleeve is not critical to the present invention, although the length is preferably selected to completely enclose the flexible pouch 14.

The flexible pouch 14 is made of one or more flexible panels of plastic sheet, which are joined to form a sealed internal compartment in which liquid such as infant formula, water, or the like is contained. Although the pouch wall is depicted, for purposes of illustration, as being of single layer construction, it may be of multiple layer construction as desired. Preferably, whether the wall is of single layer or multiple layer, it includes an oxygen barrier, such as Saran plastic of the Dow Chemical Company, to prevent substantial oxygen transmission through the wall to the contents and thus extend the shelf life of the nursing container.

The pouch 14 may typically be made of a single sheet of suitable plastic film which is folded to bring opposite ends into a generally facing relationship, so that the sides may be sealed together and the end sealed after filling, as at 28 in FIG. 2, to form an enclosed flexible container. Other suitable flexible plastic pouches or containers for use with the present invention are described more fully in U.S. patent application Ser. No. 599,415, entitled "Disposable Container, Such As A Disposable Formula Package/Nurser" in the name of James L. Cabernoch and Leonard A. White, filed concurrently herewith.

In the embodiment shown in FIGS. 2 and 3, the pouch 14 is securely mounted within the sleeve 12 by a rigid plastic disc 30 disposed between the pouch and the nipple assembly 16. The circular disc 30 is preferably made of a material, such as polypropylene or the like, which is compatible with the material of the flexible container so as to permit heat sealing of the container wall to the underside of the disc. Although preferably heat sealed to the disc, such as by sonic sealing or the like, the flexible container can also be attached to the underside of the disc by adhesive, in which case, a wider variety of materials may be used. The disk 30 has a generally thin center portion which defines the nipple access site and a relatively thick annular rim portion 32 which is rigidly secured to the shell, such as by heat or solvent bonding, adhesive or mechanical interlock. The center portion of the circular disk interior of the rim is substantially thinner than the rim for penetration by the nipple access member 26. Alternatively, the center area of the disc may be left open as in FIG. 5, thus creating a penetrable membrane when it is joined to the flexible container, or the aperture left in the center of the disc may be covered by membrane 75 of material mutually compatible with the disc and the nipple should it be desired to maintain the nipple assembly in sterile condition.

The nipple assembly 16 shown in FIGS. 2 and 3 has a self-opening feature which permits the user to access the contents of the flexible pouch 14 by manual manipulation of the dispensing nipple. The particular nipple assembly shown, as well as numerous other embodiments, are described and claimed in co-pending U.S. patent application Ser. No. 599,305, entitled "Self-Opening Nipple Construction and Nursing Container" to Leonard A. White, which is being filed simultaneously herewith.

As shown in FIGS. 2 and 3, the generally hollow flexible nipple portion 24 of the nipple assembly is preferably molded of resilient elastomeric material, such as thermoplastic elastomer, suitable for heat sealing to the upper surface of the circular disc 30 at the attachment site. To provide for such attachment, the nipple portion 24 has a generally radially extending base flange 34 which is attached to the upper surface of the circular disc 30 by heat bonding, solvent bonding, adhesive, or mechanical interlock.

To access the contents of the pouch, the accessing member 26 is located within the hollow nipple 24, and cooperative with the nipple for movement from a retracted position shown in FIG. 2, to an accessing position as shown in FIG. 3 for piercing the disc 30 and the pouch wall to permit dispensing of those contents through dispensing aperture at 38 in the flexible nipple portion 24. More particularly, the nipple 24 depicted in the present invention, has an upstanding side wall 40 which terminates in a generally spherical dispensing end portion 42. The accessing member 26 is a generally hollow elongated spike, tapered at one end 44 for puncturing the disc 30 and the flexible pouch wall, and generally spherical at the other end 46. Prior to use, the accessing spike is normally in the retracted position depicted in FIG. 2, with the spherical end 46 of the spike located within the spherical end 42 of the nipple, and the tapered end of the spike 44 above the sealed disc and container. To breach the pouch wall, the end of the nipple is compressed laterally, forcing the accessing spike 26 in an axially downward direction causing it to penetrate the disc as well as the wall of the pouch 14. Inadvertent retraction of the spike from the downwardly extended position shown in FIG. 3 is prevented by a plurality of barbs 48 spaced around the spike that engage beneath the pouch wall and the disc. The liquid in the pouch may then flow through passageway 50 in the spike for dispensing through the nipple. As additional insurance against retraction, the spherical end 46 of the spike is larger than the inside diameter of the sidewall 40 such that it will engage against the side wall upon any possible retracting movement.

To maintain the nipple 24 is a sterile condition until the infant is to be fed, a plastic cover 52 of E.V.A./-polyethelene or other suitable matter is heat sealed along a lower radial flange portion 54 to the upper surface of the base flange 34 of the nipple and encloses the dispensing end of the nipple. The sterility cover may include a pull tab 56 for easy removal of the cover.

To protect the nipple assembly and sterility cover of the container in FIGS. 2 and 3 from damage during shipment and storage, the rigid protective cover 18 is located over the entire nipple assembly. The cover 18 includes a lower edge flange of 58 for snap fit against the inside edge of the annular rim 32 of the circular disc 30. The protective cap is preferably made of a general rigid polypropylene although other material may also be suitable.

To add rigidity to the container sleeve 12, as well as to provide stacking convenience, a generally circular base ring 60 may be attached to the other end of the sleeve opposite the nipple assembly 16. The base ring 60 is secured to the shell by a heat, solvent or adhesive bonding, or mechanical interference fit, along a peripheral grove 62 in the base ring. The base ring is generally L-shaped so as to define a flat undersurface 64 which can rest on flat surfaces, countertops and the like. Alternatively a rolled lip or flange may be formed on the end of the sleeve 12.

For stacking convenience, the base ring 60 has a generally circular aperture 66 which is sized to nest over the upper portion of the cover 18 when containers are stacked atop one another, thereby saving space in shipping or storing and adding stability to the stacking arrangement. To achieve this stacking construction, the protective cover 18 has a generally tapered side wall portion 68 and a dome shaped top wall 70 joined together along a generally annular shoulder 72. The aperture 66 of the base ring 60 is sized to receive the dome shaped top wall therein, with the peripheral edge of the base ring resting on the shoulder 72 of the protective cover of the container therebelow.

Figure 4:
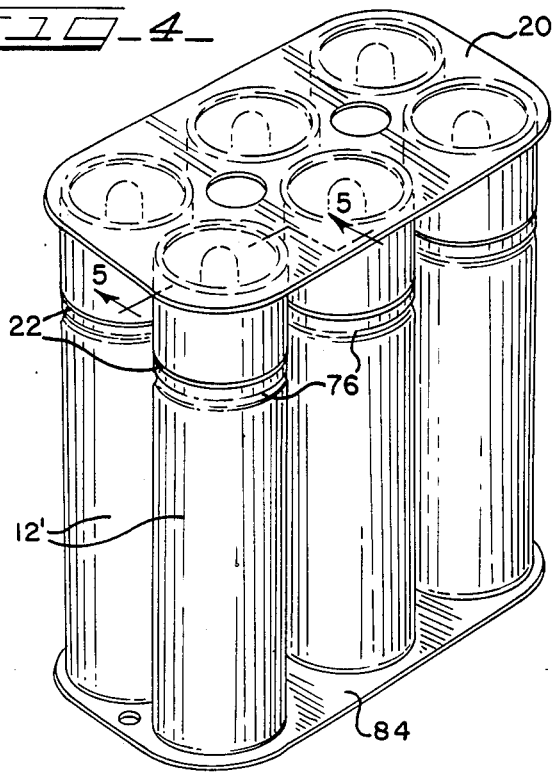
FIG. 4 is a general perspective view of a packaging arrangement for nursing containers embodying the present invention.
Figure 6:
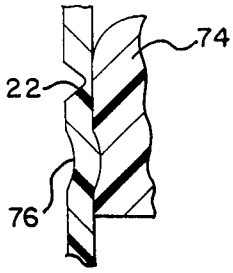
FIG. 6 is an enlarged view of a portion of the container of FIG. 5 depicting more clearly the attachment of the nipple assembly to the container and a frangible wall portion which permits removal of the end of the container to access the nipple assembly.

A further embodiment of the present invention and a unique packaging arrangement therefor are depicted in FIGS. 4–6. Referring first to FIG. 5, the nursing container 10' of FIG. 5 has a generally hollow cylindrical substantially rigid plastic outer sleeve or shell 12' made of similar material and having similar characteristics as the sleeve or shell described in connection with the other embodiment. Also similarly, the container contents are enclosed within a flexible pouch of 14' enclosed within the shell. In the embodiment of FIG. 5, however there is no separate circular disc attaching the pouch to the shell and to the nipple assembly. Instead, the nipple 24' has a substantially radially extending rigid base flange portion 74 which engages tightly against the inside surface of the shell 12'. To secure the radial flange of the nipple tightly within the inside surface of the sleeve, an annular indentation 76 (FIG. 6) is formed in the side wall of the sleeve by a deforming operation, such as by heat swaging or other techniques, to tightly grip the edge of the radial flange 74. Alternatively, spaced indentations may be provided in the sleeve to create an interference fit with the radial flange 74.

A diaphragm or membrane 75 may be bonded to the underside of the nipple flange 74 to seal the lower opening 77 through the nipple flange. This may be used, for example, where the nipple is provided as a pre-assembled and/or pre-sterilized unit for attachment to the container.

As shown in FIG. 5, the sleeve 12' is sized so that the nipple assembly is located fully within the side wall of the shell, and the length of the shell is selected such that the portion of the shell below the nipple flange is of sufficient length to enclose the flexible pouch 14' which is bonded by heat, solvent or adhesive to the underside of the nipple flange. The sleeve and pouch are preferably made of the same materials described in connection with the earlier embodiment. With the exception of the different flange construction, the shape and function of the nipple 24', sterility cover 52' and accessing member 26' in the embodiment shown in FIG. 5 are essentially the same as that described in connection with those same features in FIGS. 2 and 3.

In the embodiment of FIGS. 4, 5 and 6, the end of the container enclosing the nipple assembly is sealed in a manner which also provides for a unique packaging and storing arrangement. More particularly, as shown in FIG. 4, a plurality of the nursing containers are disposed in a generally side by side relationship, and a flexible layer or cover sheet 20 is peelably sealed to the upper edges of the shells, simultaneously providing a protective enclosure for the nipple assembly as well as joining the containers together in a unitary pack. For improved sealing, as well as to avoid sharp edges, the end edges of the shell 12 may be inwardly turned or rounded. Although it is understood that the packing arrangement would have sufficient rigidity and strength with the top cover sheet or film 20 alone, the bottom of the sleeve may also be sealed by a film or web 84 of plastic, paperboard, foil or other suitable material making the unitary pack of nursing containers even stronger, and reducing the possibility that a container will inadvertently be removed or lost.

For access to the nipple assembly 16' of the container in FIG. 5, the frangible line of weakness 22 is defined in the wall of the sleeve intermediate the ends to permit the top portion of the sleeve to be broken off to expose the nipple assembly. Although the frangible line of weakness may be provided employing various techniques well known in plastic manufacturing, in the illustrated embodiment the line of weakness 22 is provided by an annular groove around the shell which defines a line of reduced thickness that permits the end of the sleeve to be easily manually broken from the remainder.

Although the present invention has been described in terms of the preferred and alternative embodiment, the present invention, as defined in the appended claims is not limited to the precise embodiments shown, but is intended to include those equivalent structures which may be apparent to persons skilled in the art.

What is claimed is:

1. A nursing container comprising:
a substantially rigid elongated hollow sleeve;
a sealed flexible pouch of liquid disposed within said sleeve, said sealed flexible pouch defining by itself a sealed internal compartment within said sleeve;
a nipple assembly attached to said sealed flexible pouch for dispensing the contents thereof; and
a substantially rigid base carrying said nipple assembly and closing one end of said sleeve.

2. A nursing container in accordance with claim 1 further comprising means defining a protective cover over said nipple assembly, said cover being adapted for snap-attachment to said rigid base.

3. A nursing container in accordance with claim 1 wherein said nipple assembly comprises a flexible nipple dispensing end portion, and means defining a cover hermetically sealed over said flexible dispensing portion to prevent contamination thereof.

4. A nursing container in accordance with claim 1 wherein said flexible pouch is sealed to the underside of said rigid base.

5. A nursing container in accordance with claim 4, wherein said nipple assembly comprises a flexible nipple dispensing portion and pouch accessing means disposed within said flexible portion and movable axially upon compression of said flexible nipple portion to penetrate the wall of said pouch to provide access between the contents thereof and said nipple dispensing portion.

6. A nursing container in accordance with claim 1 further comprising a rigid base portion attached to the other end of said sleeve and defining a flat surface to permit resting of said nursing container on a flat surface.

7. A nursing container in accordance with claim 6 further comprising a rigid protective cover enclosing said nipple assembly, said cover having an annular shoulder and said rigid base portion including an aperture of sufficient size that the peripheral edge of an aperture of one nursing container will rest on said annular shoulder of the cover of another nursing container when stacked atop the other nursing container.

8. A nursing container in accordance with claim 1 wherein the flexible pouch is hermetically sealed.

9. A nursing container in accordance with claim 8 wherein the flexible pouch includes an oxygen barrier.

10. A container for fluid, comprising:
a substantially rigid elongated hollow sleeve;
a sealed flexible pouch of liquid disposed within said sleeve, said sealed flexible pouch defining by itself a sealed internal compartment within said sleeve;
an access assembly attached to said sealed flexible pouch for dispensing the contents thereof; and
a substantially rigid base carrying said access assembly and closing one end of said sleeve.

11. A container in accordance with claim 10 further comprising means defining a protective cover over said access assembly, said cover being adapted for snap-attachment to said rigid base.

12. A container in accordance with claim 10 wherein said access assembly comprises a flexible dispensing member, and means defining a cover hermetically sealed over said flexible dispensing member to prevent contamination thereof.

13. A container in accordance with claim 10 wherein said flexible pouch is sealed to the underside of said rigid base.

14. A container in accordance with claim 13, wherein said access assembly comprises a flexible dispensing member and pouch accessing means disposed within said flexible dispensing member and movable axially upon compression of said flexible dispensing member to penetrate the wall of said pouch to provide access between the contents thereof and said dispensing member.

15. A container in accordance with claim 10 further comprising a rigid base portion attached to the other end of said sleeve and defining a flat surface to permit resting of said container on a flat surface.

16. A container in accordance with claim 15 further comprising a rigid protective cover enclosing said access assembly, said cover having an annular shoulder and said rigid base portion including an aperture of sufficient size that the peripheral edge of an aperture of one container will rest on said annular shoulder of the cover of another container when stacked atop the other container.

17. A container in accordance with claim 10 wherein the flexible pouch is hermetically sealed.

18. A container in accordance with claim 17 wherein the flexible pouch includes an oxygen barrier.

* * * * *